United States Patent [19]

Wetter

[11] Patent Number: 4,986,730

[45] Date of Patent: Jan. 22, 1991

[54] STACKING APPARATUS FOR CONTINUOUSLY ARRIVING GENERALLY RECTANGULAR PRINTED PRODUCTS

[75] Inventor: Jakob Wetter, Wetzikon, Switzerland

[73] Assignee: Ferag AG, Hinwil, Switzerland

[21] Appl. No.: 438,328

[22] Filed: Nov. 15, 1989

[30] Foreign Application Priority Data

Nov. 23, 1988 [CH] Switzerland ..... 04353/88

[51] Int. Cl.[5] ..... B65H 29/18

[52] U.S. Cl. ..... 414/792.7; 414/794.4; 414/792.3; 271/185; 271/220; 198/457

[58] Field of Search ..... 198/457, 604, 644; 271/184, 185, 207, 220, 251, 306; 414/788.3, 791.1, 792, 792.3, 792.4, 793.1, 793.3, 794.4, 794.8, 788.9, 790.9, 791, 792.7

[56] References Cited

U.S. PATENT DOCUMENTS

| | | | |
|---|---|---|---|
| 2,819,661 | 1/1958 | Howdle et al. | 414/788.3 |
| 2,951,408 | 9/1960 | Novick | 198/457 X |
| 3,239,676 | 3/1966 | Pali . | |
| 3,363,783 | 1/1968 | Rehm | 414/790.9 X |
| 3,758,104 | 9/1973 | Daily | 271/185 |
| 4,214,743 | 7/1980 | Meier | 271/184 X |
| 4,541,763 | 9/1985 | Chandhoke et al. | 414/790 |
| 4,572,350 | 2/1986 | Besemann | 198/457 X |

FOREIGN PATENT DOCUMENTS

| | | | |
|---|---|---|---|
| 2823247 | 11/1979 | Fed. Rep. of Germany | 271/184 |
| 412032 | 7/1910 | France . | |
| 1568752 | 6/1980 | United Kingdom . | |

*Primary Examiner*—Robert J. Spar
*Assistant Examiner*—James T. Eler
*Attorney, Agent, or Firm*—Bell, Seltzer, Park & Gibson

[57] ABSTRACT

This invention is directed to an apparatus for stacking sheet-like articles (15) which are delivered by a conveyor to the upper portion of a stack compartment (18). The stack compartment (18) includes stop rails (19, 20, 21, 22) which define the edges of the stack. The sheet-like articles (15) on the section (12) of the conveyor are fed with one of the corners in front in a conveying direction (17) which forms an angle other than 0° and 90°, preferably about 45°, with the side edges of the sheet-like articles (15) adjoining the corner so that the sheet-like articles strike against two stop rails (19, 20) which are mutually at right angles at the moment the sheet-like articles reach the stack compartment. Accordingly, the sheet-like articles will each be properly aligned by the two stop rails (19, 20) to form a neat, right-parallelepipedal stack.

7 Claims, 4 Drawing Sheets

STACKING APPARATUS FOR CONTINUOUSLY ARRIVING GENERALLY RECTANGULAR PRINTED PRODUCTS

FIELD OF THE INVENTION

This invention relates to an apparatus for stacking continuously arriving generally rectangular printed products.

BACKGROUND OF THE INVENTION

Devices for stacking printed products are generally known, for example, from British Patent Specification No. 1,568,752. In the above British patent, the section of the conveyor directly delivering printed products to the stack compartment is arranged underneath the preceding section and has a virtually opposite conveying direction in relation to the latter. Thus, the printed products therefore arrive in the stack compartment with a leading edge which was the trailing edge on the preceding section of the conveyor. This is advantageous whenever the arriving printed products arrive in a conventional imbricated formation, in which the leading edge of the printed products is formed by the fold, while the opposite edge is a so-called cut edge. Consequently, in the above known apparatus, the more critical edge of the printed products, namely the fold, is prevented from striking the stop rails limiting the stack compartment on arrival in the stack equipment. Moreover, the conveying direction of both sections of the conveyor is always essentially at right angles to the leading edge and the trailing edge of the printing products. This has the consequence that, on arrival in the stack compartment, only the respective leading edge strikes the opposite stop rail and is thereby aligned in the stack being formed, while the side edges remain unguided on arrival in the stack compartment and consequently are not automatically aligned. Thus, side aligners, which align the side edges of the arriving printing products with respect to one another are necessary in the stack compartment and/or on the section of the conveyor entering the latter in order to produce a neat, right-parallelepipedal stack.

Accordingly, it is an object of the present invention to design stacking apparatus so that a neat, right-parallelepipedal stack is produced without additional technical measures.

SUMMARY OF THE INVENTION

The above and other objects of the present invention are achieved by the provision of an apparatus for stacking generally rectangular printed products comprising a stack compartment arranged to be charged from above and comprising at least two generally perpendicular stop rails defining the edges of the stack. A conveyor is disposed to deliver printed products to the stack compartment which comprises first and second generally coplanar adjoining conveyor sections wherein the second section is disposed to deliver the printed products directly to the stack compartment. Each of the conveyor sections have a conveying direction wherein the conveying direction of the first conveyor section is at a non-perpendicular angle to the second conveyor section so that the printed products arrive in the stack compartment with one of its corners in front.

In a preferred arrangement of the apparatus, the sections of the conveyor are disposed at an angle of approximately 45° to one another to provide the printed products at a 45° angle as they enter the stack compartment. The second section of the conveyor preferably comprises a plurality of parallel bands with co-running pressing belts overlying the bands so as to grip the printed products between the bands and the belts as the printed products are delivered to the stack compartment. The speed of each conveyor section is further controlled so that the second section has a speed component with a magnitude and direction corresponding to the magnitude and direction of the speed and conveying direction of the first section to provide a gentle transition for the printed products between the first and second conveyor sections.

BRIEF DESCRIPTION OF THE DRAWINGS

Some of the features and advantages of the invention having been stated, others will become apparent as the description proceeds when taken in conjunction with the accompanying drawings in which.

DETAILED DESCRIPTION OF THE PREFERRED EMBODIMENT

Figure 1:
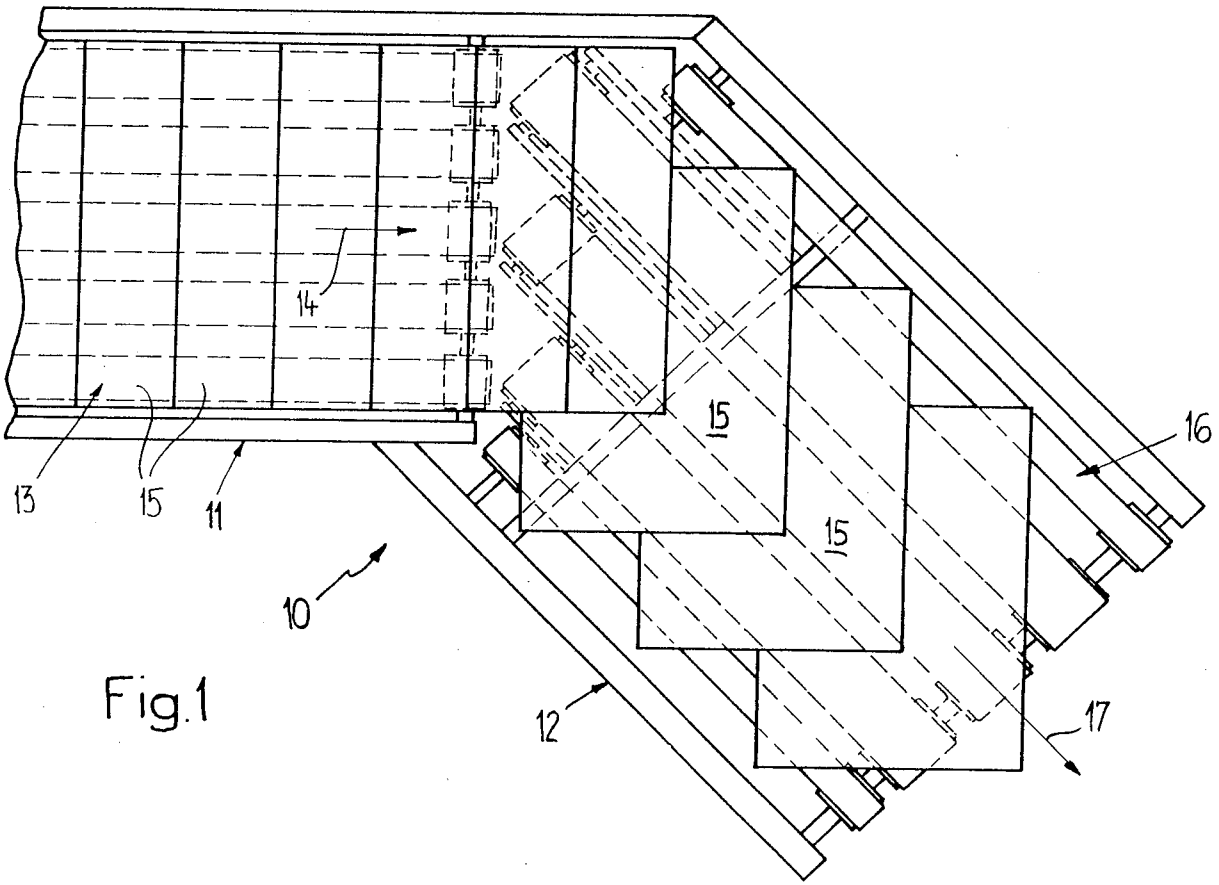
FIG. 1 is fragmentary top plan view of the two sections of the conveyor leading to the stack compartment.

Referring now more particularly to the drawings, a conveyor, generally indicated by the numeral 10, is illustrated in FIG. 1. The conveyor 10 consists of a first conveyor section 11 and a second conveyor section 12 adjoining one another and lying in a generally common plane.

The first conveyor section 11 consists of a band conveyor 13 on which printed products 15, such as newspapers, are conveyed in the direction of the arrow 14 in a freely resting imbricated formation. The conveying direction 14 is at right angles to the leading and trailing edges of the printed products 15. The second conveyor section 12 adjoining the end of the first conveyor section 11 is likewise comprised of a band conveyor 16 having a conveying direction 17. The conveying direction 17 is diverted in relation to the conveying direction 14 of the section 11 by a non-perpendicular angle. In the preferred embodiment, the angle is about 45°. The printed products 15 are transferred onto the second conveyor section 12 from the first conveyor section 11 and are conveyed in an imbricated formation, but having a position relative to the conveying direction 17 being turned about 45° with respect thereto so that a corner of each rectangular printed product forms the leading end thereof.

The conveying speed in the conveying direction 17 expediently has a component which corresponds in terms of direction and magnitude to the speed in conveying direction 14. As a result, the transfer of the newspapers from the first conveyor section 11 to the second conveyor section 12 is particularly "gentle" and only a minimum degree of acceleration results in forces acting on the newspaper.

Figure 2:
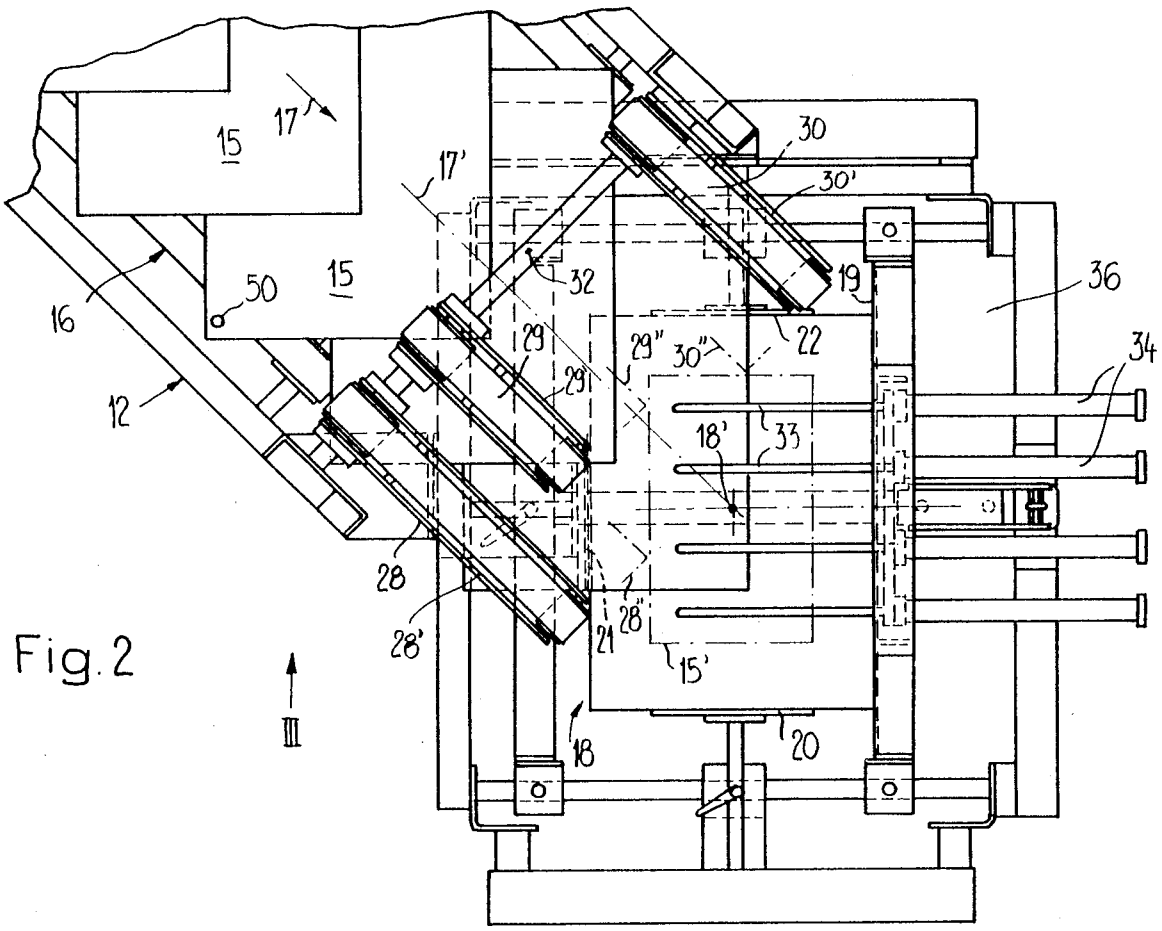
FIG. 2 is a fragmentary top plan view of the stacking apparatus particularly illustrating the end of the second section of the conveyor entering the stack compartment.
Figure 3:
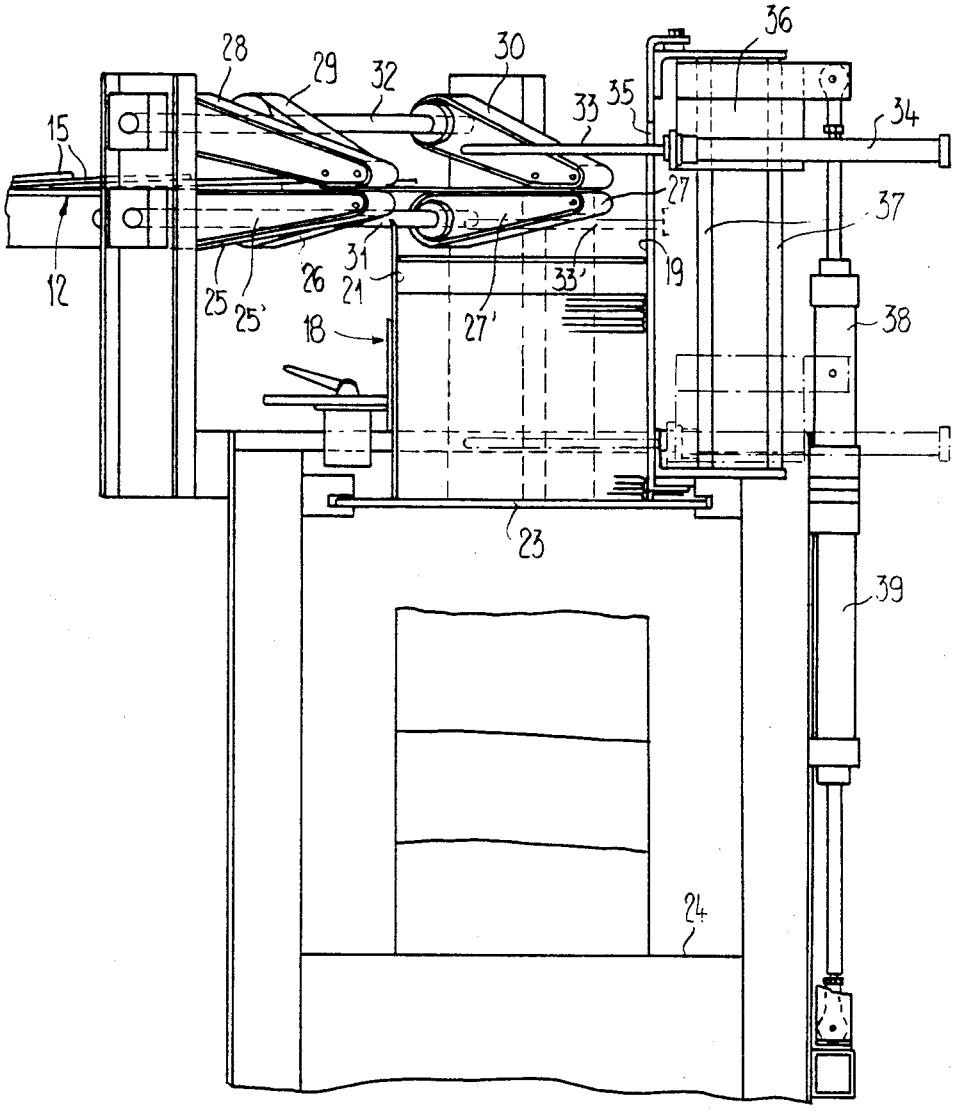
FIG. 3 is a side elevation view of the stacking apparatus looking in the direction of arrow III in FIG. 2.

Referring now to FIGS. 2 and 3, one can see the end of the second conveyor section 12 of the conveyor 10, which enters a stack compartment 18. The stack compartment 18 is arranged to be charged from above and comprises at least two generally perpendicular stop rails 19 and 20. The bottom of the stack compartment 18 is formed by a slide 23 (or by a pair of slides), which is displaceable in a direction at right angles to the plane of the drawing in the representation of FIG. 3. Arranged underneath the slide 23 is a stack board 24, which can be raised and lowered by means not shown in any more detail and can be pivoted in each case by 180° about a generally vertical axis.

The end of the second section 12 is formed by a set of three in-feed bands 25, 26, 27 (FIG. 3), each with an assigned co-running pressing belt 28, 29, 30. Each of the in-feed bands form with the assigned pressing belt, a conveying nip which clamps the printed products 15 taken over from the band conveyor 16 and continues conveying them in the same direction with one corner in front. The bands 25, 26, 27 are driven at the same speed as the band conveyor 16. The pressing belts 28, 29, 30 may likewise be driven at the same speed or idle freely. FIGS. 2 and 3 also show the deflection rollers (not denoted by numerals) forming the ends of the active sides of the bands 25 and 26 and the assigned pressing belts 28 and 29 being arranged adjacent the stop rail 21 and just outside the stack compartment 18. In a similar manner, the deflection rollers of the in-feed band 27 and of the pressing belt 30 are arranged adjacent the stop rail 22 and outside the stack compartment 18. This ensures that the printed products 15, which are clamped approximately along their diagonal, are also guided at their center of gravity until directly before each printed product 15 strikes with its side edges against the stop rails 19 and 20. Consequently, two side edges mutually at right angles of each fed printed product 15 in the stack being formed are thus fixed in their position by the two corresponding stop rails 19 and 20.

The deflection rollers for the bands 25, 26, 27 and for the pressing belts 28, 29, 30 are each mounted rotatably in a respective frame 25', 27', 28', 29' and 30' (the frame of the in-feed band 26 cannot be seen in the figures). The frames for the bands 25, 26, 27 are mounted at their leading end to a transversely extending lower running shaft 31. The frames 28', 29' and 30' are similarly mounted at their leading end to a transversely extending upper running shaft 32. The frames for each of the bands and belts are adapted to be repositioned along each of the respective shafts 31, 32 to permit adjustment of the apparatus for different sizes and formats of printed products. If, for example, sheet-like articles which have the format indicated in FIG. 2 by the dot-dashed outline 15' are to be stacked, the pressing belt 30, with the assigned in-feed band 27, can be repositioned by displacement of the frames 30' and 27', on the shafts 32 and 31, into the position which is indicated in FIG. 2 by the dot-dashed line 30''. The same applies analogously to the pressing belt 29 with the associated in-feed band 26 and to the pressing belt 28 with the associated in-feed band 25, the displaced positions for these pairs of elements being indicated by the dot-dashed lines 29'' and 28'', respectively. Of course, the stop rails 19-22 can also be adapted by displacement to the format of the arriving sheet-like articles, as is generally usual for stacking devices. It is advantageous, if the longitudinal center line 17' of the section 12 intersects the center axis 18' of the stack compartment 18, as indicated in FIG. 2.

Apart from the elements already described, the stack compartment 18 is provided with a set of carrying prongs 33, which can each be extended into the stack compartment 18 and withdrawn from it through longitudinal openings 35 in the stop rail 19 by means of a pneumatic or hydraulic cylinder 34. The cylinders 34 are fitted fixedly on a carriage 36, which is displaced vertically, guided on columns 37, by means of two series-connected pneumatic or hydraulic units 38, 39. When both units 38, 39 are fully extended, the cylinders 34 are in the position represented in solid lines in FIG. 3 above the end of the in-feed bands 25 to 27. When only the unit 38 is retracted, but the unit 39 is still extended, the cylinders 34, and consequently the carrying prongs 33 (if extended) are in the position indicated in FIG. 3 by dot-dashed lines and denoted by 33', directly underneath the end of the in-feed bands 25, 26, 27. When both units 38, 39 are retracted, the cylinders 34, and the carrying prongs 33, are in the position likewise indicated by dot-dashed lines in FIG. 3 just above the slide 23.

Figure 4A:
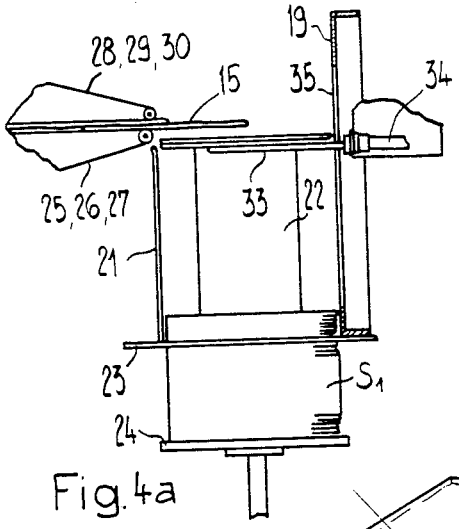
FIG. 4*a* is a reduced side elevation view of the stacking apparatus similar to FIG. 3 illustrating one of the various working phases of the apparatus.

Turning now to the operation of the apparatus it may be seen in FIG. 4*a* that the carrying prongs 33 are extended and in the position indicated in FIG. 3 by 33'. They consequently form a temporary depositing surface for printed products 15 leaving the in-feed bands 25, 26, 27 and the pressing belts 28, 29, 30. The printed products 15 upon entering the stack compartment strike against the stop rails 19 and 20. The slide 23 is open and the parts $S_1$ of a stack formed thus far rests on the lowering stack board 24.

Figure 4B:
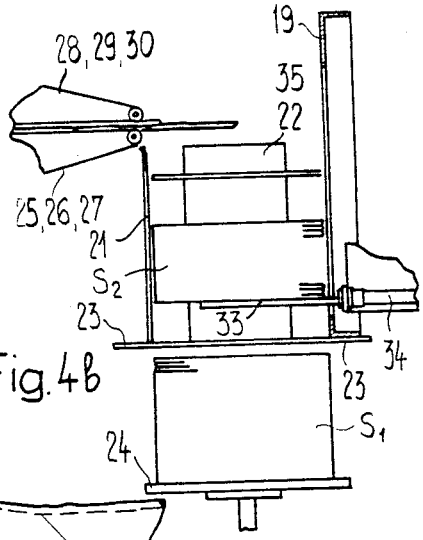
FIG. 4*b* is a side elevation view similar to FIG. 4*a* illustrating a second working phase of the apparatus.

Turning to FIG. 4*b*, the carrying prongs 33 have moved downwardly to accommodate the delivered printed products and have almost reached their lowermost position carrying a further part $S_2$ of the stack to be formed. In the meantime, the upper side of the part $S_1$ already formed has been withdrawn underneath the slide 23, which has subsequently been brought into the closed position. The stack board 24 rotated through 180° about a generally vertical axis so that, in the case of newspapers, the folds will not all be disposed along one side of the stack.

Figure 4C:
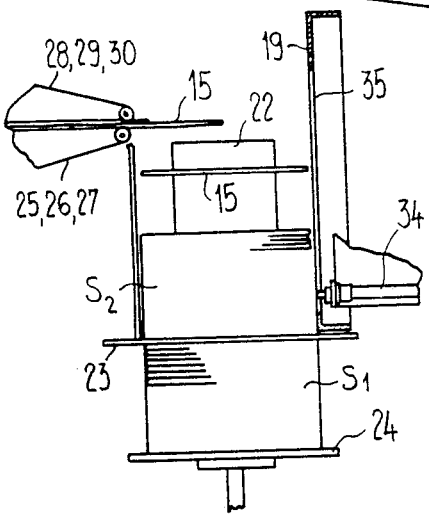
FIG. 4*c* is similar to FIG. 4*a* illustrating a third working phase of the apparatus.
Figure 4D:
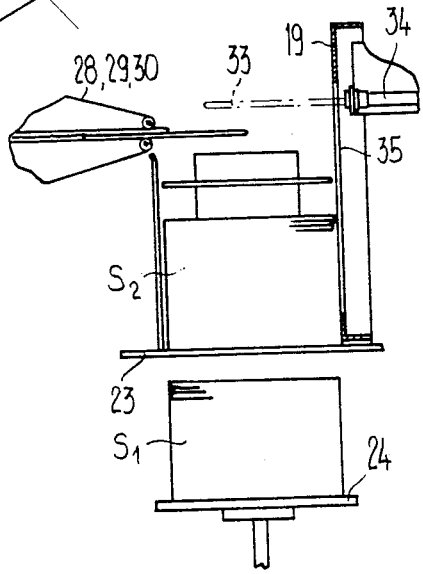
FIG. 4*d* is similar to FIG. 4*a* illustrating a fourth working phase of the apparatus.

In FIG. 4*c*, the carrying prongs 33 have been retracted and have deposited the part $S_2$ of the stack, still in the process of formation, on the now closed slide 23. At the same time, the stack board 24 is raised, so that the part $S_1$ of the stack located on it is pressed against the lower side of the slide 23, so that it is compressed and flattened. In FIG. 4*d*, the cylinders 34, and consequently the carrying prongs 33, have been displaced into their uppermost position and then the carrying prongs 33 have been extended again. In the meantime, the completion of the part $S_2$ of the stack resting on the slide 23 takes place, while the stack board 24 with the now turned and pressed part $S_1$ has lowered slightly. The slide 23 can then be opened and the prongs lowered into the position 33' and the situation of FIG. 4*a* is reached again.

Figure 5:
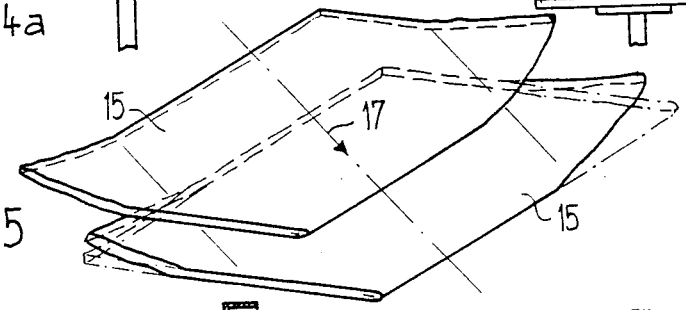
FIG. 5 is a top perspective view of the printed products having a curvature imparted therein during conveyance.

In FIG. 3, in a preferred embodiment, the ends of the in-feed bands 25 and 27 are adjusted with the corresponding pressing belts 28 and 30 to a slightly greater height than the end of the in-feed band 26 and its corresponding pressing belt 29. As such the printed products 15 arriving in the stack compartment 18 in the direction of the arrow 17 are pressed into the shape which can be seen in FIG. 5. This shape comprises a curvature about axes parallel to the direction 17. This curvature results in a stiffening of the printed product 15 in the conveying direction.

The invention is not restricted to the exemplary embodiment described. The stack compartment and the elements assigned to it may be designed in some other way, provided that the stack compartment is laterally limited by at least one pair of stop rails mutually at right angles, so that the side edges of the printed products which adjoin the leading corner thereof is in front and strikes against the stop rails virtually simultaneously when the printed products reach the stack compartment and consequently are aligned in the stack being formed.

The imbricated formation of the printed product 15, fanned out to a certain extent, on the section 12, also makes possible a satisfactory counting of the newspaper 15 directly before they arrive in the stack compartment 18. The counting may be performed, for example, by means of a light barrier. The control beam of the light barrier, as indicated in FIG. 2 penetrates the conveyor plane of the section 12 at the point 50. No matter how the counting pulse generator effecting the counting is designed, it is important that the counting is performed directly before the arrival in the stack compartment 18. This means that the counting result represents virtually without delay the actual number of printed products in the stack compartment 18 and that any irregularities in the imbricated formation on the section 11 or at the beginning of the section 12 (for example due to a removed newspaper) do not influence the counting result.

The foregoing description is considered to be illustrative of the invention rather than restrictive, and those modifications which come within the meaning and range of equivalence of the claims are to be included therein.

That which is claimed is:

1. An apparatus for stacking generally rectangular printed products (15) arriving in a generally continuous series, said apparatus comprising a stack compartment (18) arranged to be charged from above and comprising at least two generally perpendicular stop rails (19, 20) defining edges of a stack, and a conveyor (10) disposed for delivering printed products to said stack compartment (18), said conveyor comprising first and second generally coplanar adjoining conveyor sections (11, 12) wherein the second conveyor section (12) directly delivers printed products to the stack compartment (18), and wherein the second conveyor section (12) has a conveying direction (17) disposed at an angle which is non-perpendicular and non-parallel to the conveying direction of the first conveyor section so that each of the printed products (15) is transferred from the first conveyor section to the second conveyor section such that a corner of the rectangular printed product becomes a leading corner while on said second conveyor, and arrives in the stack compartment (18) with said leading corner in front, and wherein the printed products abut and form a stack against the two stop rails.

2. The apparatus as defined in claim 1, wherein the stack compartment comprises a second two generally perpendicular stop rails (21, 22) disposed with the first said two stop rails (19, 20) to define the edges of a generally rectangular stack, and wherein the second section (12) is formed of a plurality of parallel endless bands (16, 25, 26, 27) having deflection rollers at distal ends thereof, and further wherein the deflection rollers are positioned adjacent at least one of said second two stop rails (21, 22) and outside of the stack compartment (18).

3. The apparatus as defined in claim 2, wherein a plurality of co-running pressing belts (28, 29, 30) corresponding to the number of bands (25, 26, 27) overlie the distal ends of the bands (16, 25, 26, 27).

4. The apparatus as defined in claim 2, wherein said parallel endless bands comprise two laterally positioned bands and further wherein the deflection rollers of the laterally positioned bands are adjustable in height relative to the remaining deflection rollers (16, 25, 26, 27) so as to impart in the printed products (15) a curvature having axes of curvature parallel to the conveying direction (17) of the second section (12).

5. The apparatus as defined in claim 1, further comprising means for controlling the conveying speed of the second conveyor section (12) so as to have a component which corresponds in terms of magnitude and direction to the conveying speed of the preceding section (11).

6. The apparatus as defined in claim 1, wherein the conveying direction of the second section (12) of the conveyor (10) is disposed at an angle of about 45° to the conveying direction of the first section (11).

7. The apparatus as defined in claim 1, wherein the stack compartment (18) has a generally vertical center axis (18') and the second conveyor section (12) has a generally horizontal center line (17'), and further wherein the second conveyor section (12) is disposed so that the longitudinal center line (17') intersects the center axis (18') of the stack compartment (18).

* * * * *